United States Patent [19]

Macgrory et al.

[11] 4,427,144

[45] Jan. 24, 1984

[54] PLASTICS FILM DISPENSER

[75] Inventors: Wallace J. Macgrory; George C. Frederick, both of Manly, Australia

[73] Assignee: EZY Wrap Products Pty. Limited, Manly, Australia

[21] Appl. No.: 261,179

[22] PCT Filed: Aug. 25, 1980

[86] PCT No.: PCT/AU80/00049

§ 371 Date: May 5, 1981

§ 102(e) Date: Apr. 29, 1981

[87] PCT Pub. No.: WO81/00704

PCT Pub. Date: Mar. 19, 1981

[30] Foreign Application Priority Data

Sep. 5, 1980 [AU] Australia ..... PE0355

[51] Int. Cl.[3] ..... B65H 35/04; B65H 35/06

[52] U.S. Cl. ..... 225/7; 83/171; 83/544; 83/650; 225/20; 225/21

[58] Field of Search ..... 83/171, 141, 396, 544–546, 83/649, 650; 225/20, 21, 38, 7; 53/390; 242/55.53

[56] References Cited

U.S. PATENT DOCUMENTS

| | | | |
|---|---|---|---|
| 1,231,415 | 6/1917 | Nebergall | 225/20 |
| 1,358,904 | 11/1920 | Welch | 225/38 |
| 2,924,493 | 2/1960 | Preble, Jr. | 225/38 X |
| 2,969,169 | 1/1961 | Botnick | 225/38 X |
| 3,131,278 | 4/1964 | Rosenthal | 83/171 X |
| 3,603,519 | 9/1971 | Brown | 225/38 X |
| 3,707,251 | 12/1972 | Dashnier | 225/21 |
| 3,713,569 | 1/1973 | Dashnier | 225/21 |
| 3,731,863 | 5/1973 | Nausedas | 225/20 |
| 3,782,615 | 1/1974 | Webster | 83/171 X |
| 4,018,034 | 4/1977 | Keren | 53/390 |

*Primary Examiner*—James M. Meister

*Attorney, Agent, or Firm*—Emory L. Groff, Jr.

[57] ABSTRACT

A plastic film dispenser comprising a support structure consisting of a housing (1), support means (26) for a roll of film, guide means in the form of a fixed flap (36) and a moveable flap (37) to guide film from the roll to an outlet (27). The housing is provided with a drop plate (34) moveable from a position where film being withdrawn is maintained clear of treated film severing means (41) to a position where film is contacted by the severing means. The housing preferably includes means (25) to support a roll of other material and a keeper rod (18) whereby a length of such material may be conveniently withdrawn from the roll and severed by severing means (12).

4 Claims, 2 Drawing Figures

PLASTICS FILM DISPENSER

This invention relates to a plastics film dispenser.

Because of their transparency, elastic properties, self-adhesive characteristics and extreme thinness, plastics films have proved to be extremely popular for general wrapping purposes, particularly in relation to the wrapping of foodstuffs.

Such films are as stated extremely thin and are wrapped around a tubular core usually of cardboard. The core with a cardboard film is usually housed in a dispenser consisting of a box also of cardboard and one longitudinal edge of the box usually includes a serrated cutting edge to facilitate the severance of a desired length of film from the role.

Such an arrangement has not proved to be entirely satisfactory and because the edge of the film is not normally grasped properly to withdraw it from the roll the film is drawn at an angle across the cutting edge, this causes the film to curl as it is being severed and a portion of the free end frequently contacts another portion of the film being withdrawn from the roll. Because of its self-adhesive characteristics it frequently happens that the contacting surfaces of the film adhere together. The adhering surfaces are extremely difficult if not impossible to separate. This leads to a considerable wastage of film and in some cases the self-adhesive characteristics of the film coupled with the inadequacy of the dispensing containers at present in use has inhibited the use of such films to a considerable extent.

The present invention has for its object the provision of a plastics film dispenser which overcomes the problems encountered with such dispensers at present in use and at the same time provides an inexpensive container which incorporates means whereby a length of film may be correctly withdrawn from a roll and conveniently speedily and accurately severed from the roll with minimum effort.

The plastics film dispenser according to the present invention comprises a support structure rotatably supporting a roll of plastics film therein with guide means in said structure to guide film from said roll to an outlet from said structure, film severing means located adjacent said outlet and a drop plate movable from a position where film being withdrawn from said dispenser is maintained clear of said film severing means to a position where said film is contacted by said severing means to sever a length of film from said roll.

The invention preferably includes means in the dispenser to also rotatably support a roll of material other than film e.g. metal foil, paper or the like therein and includes means whereby a length of material may be conveniently withdrawn from the roll and additional severing means are provided in order that a desired length of the material may be severed from the roll.

Figure 1:
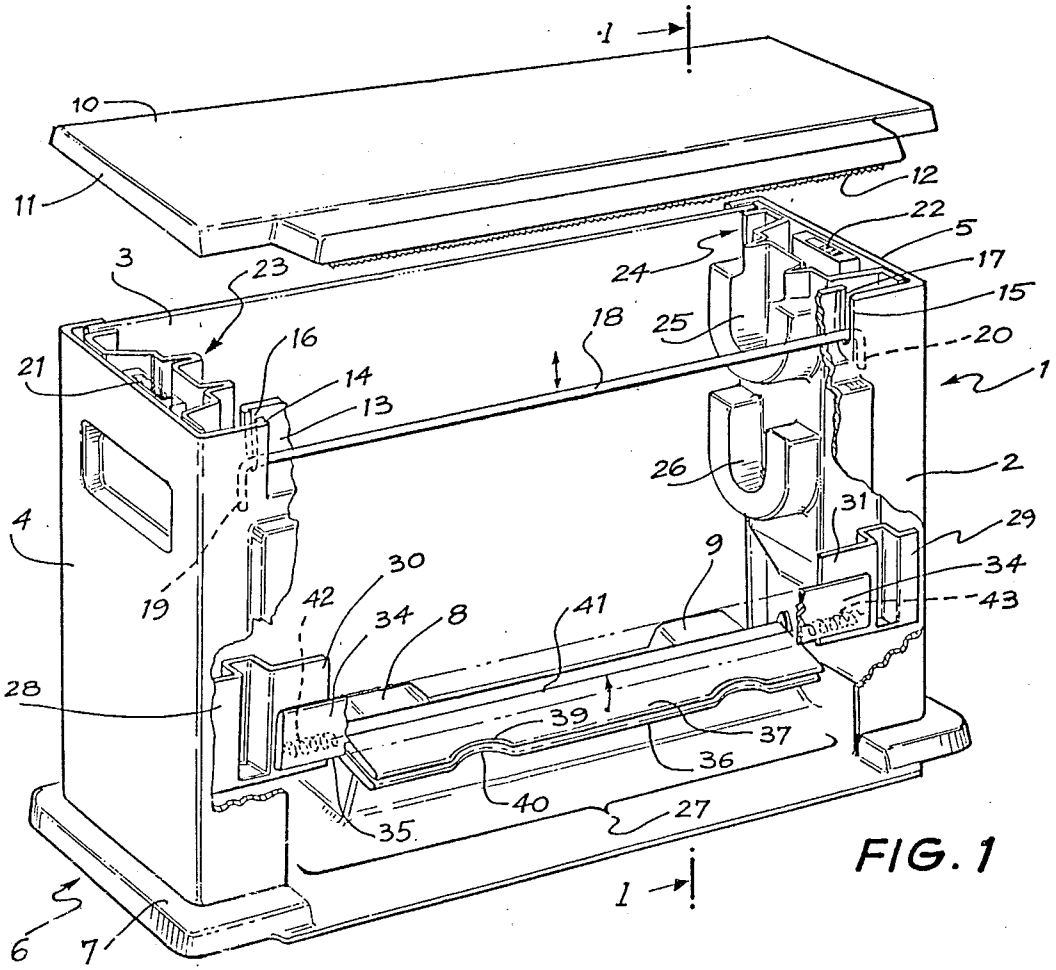
Figure 2:
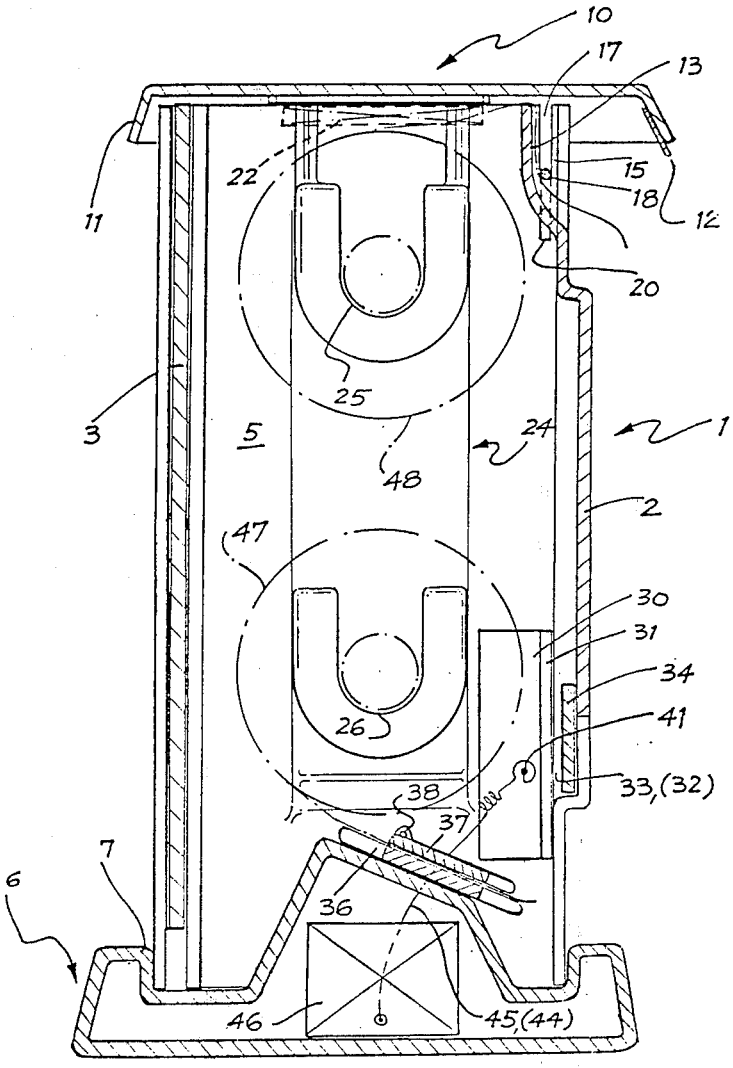

One embodiment of the invention will now be described with reference to the accompanying drawings in which:

FIG. 1 is a perspective view, partly in section illustrating a plastics film dispenser according to the invention; and FIG. 2 is a sectional view on line 1—1 of FIG. 1.

According to the preferred embodiment of the invention, the housing designated generally by the reference 1 which constitutes a support structure is formed of front wall 2, back wall 3, end walls 4 and 5 and a bottom designated generally by the reference 6.

The bottom is conveniently moulded from plastics material and includes a peripheral flange 7 which provides a seat for the front, back and end walls of the housing and located interiorally within the housing are two spaced protuberances 8 and 9 having flat ramp surfaces angled downwardly towards the front of the housing.

The top of the housing is closed by a removable lid 10 having a downturned peripheral flange 11. A portion of the flange at the front of the cabinet has a serrated cutting member 12 fixed thereto.

The front wall 2 is stepped inwardly as at 13 a short distance from each end thereof thereby providing inturned flanges 14 and 15 at each end of the housing in which is formed slots 16 and 17. Supported in the slots is a longitudinal keeper rod 18 having downturned ends 19, 20. As will be apparent from FIG. 1 the inwardly stepped portion 13 extends at the same height as the remainder of the front wall 2 throughout the length thereof.

Magnets 21, 22 are located on the interior of each end wall. These magnets are adapted to register with and engage metal keeper plates (not shown) secured to the underside of the lid 10 whereby the lid is normally retained in the closed position however other suitable catch means may be employed.

Located within the housing and fixed to the interior of each end wall are two roll supporting members 23, 24 each of which is provided with spaced upper and lower "U" shaped sockets 25, 26, the purpose of which will be explained later.

The front wall 2 terminates a short distance above the bottom 6 to provide a transverse opening 27 extending across the front of the housing. The length of this opening is at least equal to the transverse distance between the sockets 25 and 26 located at each end of the housing.

Brackets 28 and 29 are fixed to the inside of the front wall 2. These brackets have extensions 30, 31 spaced from the inside of the front wall 2. The brackets have out-turned bottom ends 32, 33 which are secured to the inside of the front wall and thereby define sockets at each end of the transverse opening 27 which support a drop plate 34 extending across the transverse opening. The sockets are so positioned that the bottom edge 35 of the drop plate terminates above the bottom 6.

A fixed flap 36 is secured to the ramp surfaces of the protuberances 8 and 9 and extends across the transverse opening. Lying closely adjacent the fixed flap is a movable flap 37 pivotally supported by brackets 38 fixed to each of the mentioned protuberances. Each flap is provided with registering cut-outs 39 and 40, the purpose of which will be explained hereafter. The flaps 36 and 37 constitute the guide means previously referred to.

A wire or metal rod 41 which constitutes the film severing means extends across the opening 27 and is secured by springs 42, 43 to the extensions 30 and 31 whereby the wire is maintained under tension. The wire is so located relative to the drop plate 34 that it is normally shrouded thereby however if the drop plate is raised relative to the opening 27 then the wire is exposed. The wire has electrical connections 44 and 45 to a low voltage transformer 46 located in the base 6 and connected to a source of electrical power. If desired a switch not shown may be interposed between the transformer and the source of electrical power.

In use a roll of plastics film 47 is rotatably supported in the sockets 26. The film is led between the fixed flap 36 and the movable flap 37. The free edge of the film may be then easily grasped by the fingers with the aid of the cut-outs 39, 40 and a length of film withdrawn from the roll. When the desired length of film has been withdrawn it is then raised upwardly. This causes the film to engage and lift the drop plate 34 thus exposing the heated wire to the film. On contact being made between the wire and the film the desired length of film is conveniently and accurately severed from the roll 47. The free end of the film still connected to the roll is retained between the fixed and movable flaps and so may be grasped as previously indicated when a further length of film is required.

The drop plate 34 normally shrouding the heated wire 41 ensures that no portion of the fingers or the hand accidentally contacts the wire in a film withdrawing operation.

Although not essential to the performance of the invention a roll of metal foil paper or the like, 48 is rotatably supported in the sockets 25. The free end of this roll is lead over the top edge of the front wall 2 and under the keeper rod 18. The free end of the roll may be then grasped by the fingers, a desired length withdrawn from the roll and severed from the roll by drawing it upwards and severing it from the roll with the aid of the serrated cutting member 12.

It will be appreciated that the foregoing description relates to a preferred embodiment of the invention only. Many modifications and variations of the component parts of the invention and their arrangement will be apparent to those skilled in the art without departing from the spirit and scope of the present invention. The claims defining the invention are as follows:

We claim:

1. A plastics film dispenser, said dispenser including a support structure comprising a housing (1) having a front wall (2), back wall (3), end walls (4,5) and a bottom (6), said front wall (2) terminating above said bottom and providing an outlet (27) from said housing, a socket (25,26) on each end wall, a roll of plastics film (47) supported in said sockets (25,26), guide means (36,37) in said housing to guide film from said roll (47) to said outlet (27), said guide means comprising a fixed flap (36) and a movable flap (37) pivotally mounted in said housing, said flaps having a substantial width and provided with a length extending continuously transversely across said outlet (27), said movable flap (37) normally overlying said fixed flap (36) with said film therebetween, film severing means (41) located adjacent said outlet, brackets (28,29) at each end of said outlet, a drop plate (34) extending across said outlet (22) and mounted in said brackets (28,29), said drop plate (34) movable from a normal position wherein film being withdrawn from said dispenser is maintained clear of said film severing means (41) to an active position where said severing means is exposed to said film for contact by said severing means to sever a length of film from said roll (47), said flaps (36,37) spaced inwardly from said outlet (27), inwardly from said film severing means (41) and inwardly from said guide means (36,37), said film severing means (41) comprising an electrically heated wire fixed in said housing across said outlet (27) and connected to an external source of power through a low-voltage transformer.

2. A plastics film dispenser as claimed in claim 1 said dispenser further including a roll of metal foil or paper rotatably supported in further sockets forming part of said end walls and located above the sockets supporting the roll of plastics film.

3. A plastics film dispenser as claimed in claim 2 wherein the housing includes a lid, the front wall adjacent the lid is angled inwardly to provide a further outlet from said housing, said lid having a cutting member fixed thereto adjacent said outlet.

4. A plastics film dispenser as claimed in claim 3 wherein a keeper rod extends across said further outlet adjacent the top edge of said front wall.

* * * * *